US006975191B2

(12) United States Patent
Ward

(10) Patent No.: US 6,975,191 B2
(45) Date of Patent: Dec. 13, 2005

(54) RESETTABLE SWITCHING DEVICE

(75) Inventor: Patrick Ward, Ballinasloe (IE)

(73) Assignee: Tripco Limited, Ballinasloe (IE)

( * ) Notice: Subject to any disclaimer, the term of this patent is extended or adjusted under 35 U.S.C. 154(b) by 8 days.

(21) Appl. No.: 10/508,351

(22) PCT Filed: Jan. 27, 2003

(86) PCT No.: PCT/IE03/00012

§ 371 (c)(1),
(2), (4) Date: Sep. 20, 2004

(87) PCT Pub. No.: WO03/081623

PCT Pub. Date: Oct. 2, 2003

(65) Prior Publication Data

US 2005/0168308 A1 Aug. 4, 2005

(30) Foreign Application Priority Data

Mar. 21, 2002 (IE) ..... S020199

(51) Int. Cl.[7] ..... H01H 51/01

(52) U.S. Cl. ..... 335/18; 335/21; 335/27; 335/167; 335/170; 335/171; 335/179; 335/182; 335/229; 335/238; 335/259; 335/265; 335/274

(58) Field of Search ..... 335/6, 15, 18–28, 335/167–171, 177–182, 238, 259, 265, 274; 361/42

(56) References Cited

U.S. PATENT DOCUMENTS 4,893,101 A * 1/1990 Robitaille ..... 335/18
5,173,673 A * 12/1992 Weigand et al. ..... 335/18
5,485,133 A * 1/1996 Ward ..... 335/78
5,563,756 A * 10/1996 Ignasiak ..... 361/42

FOREIGN PATENT DOCUMENTS

WO WO-01/45126 A1 * 6/2001

* cited by examiner

*Primary Examiner*—Ramon M. Barrera
(74) *Attorney, Agent, or Firm*—Nath & Associates PLLC; Gary M. Nath; Gregory B. Kang

(57) ABSTRACT

A resettable switching device, e.g. a relay, comprises a fixed contact (18) and a movable contact (28). A solenoid (12) is fixed relative to the fixed contact and a ferromagnetic plunger (20) carries the movable contact. A spring (24) biases the plunger away from the fixed contact so the device is normally open. When the device is set a further ferromagnetic element, e.g. a plunger (22), holds the first plunger (20) in a closed-contact position by magnetic attraction against the action of the spring (24). When a predetermined current condition exists in the solenoid the magnetic attraction between the element and plunger is reduced below the level necessary to hold the plunger so that the movable contact disengages the fixed contact.

13 Claims, 6 Drawing Sheets

RESETTABLE SWITCHING DEVICE

The present invention relates to a resettable switching device for closing, holding closed, and opening a set of electrical contacts, and may be used in applications such as residual current devices, circuit breakers, relays and similar applications.

U.S. Pat. No. 5,173,673 describes a resettable switching device according to the pre-characterising part of claim 1, wherein both the solenoid and contact closure member are movable, as a single unit, relative to fixed contacts on the board.

The present invention provides a resettable switching device as claimed in claim 1.

The advantage of the present invention is that the device can be easily mounted to a circuit board and only the mass of the contact closure member has to be accelerated in order to close the contacts.

Embodiments of the invention will now be described, by way of example, with reference to the accompanying drawings, in which.

In the drawings the same reference numerals have been used for the same or equivalent components.

Figure 1:
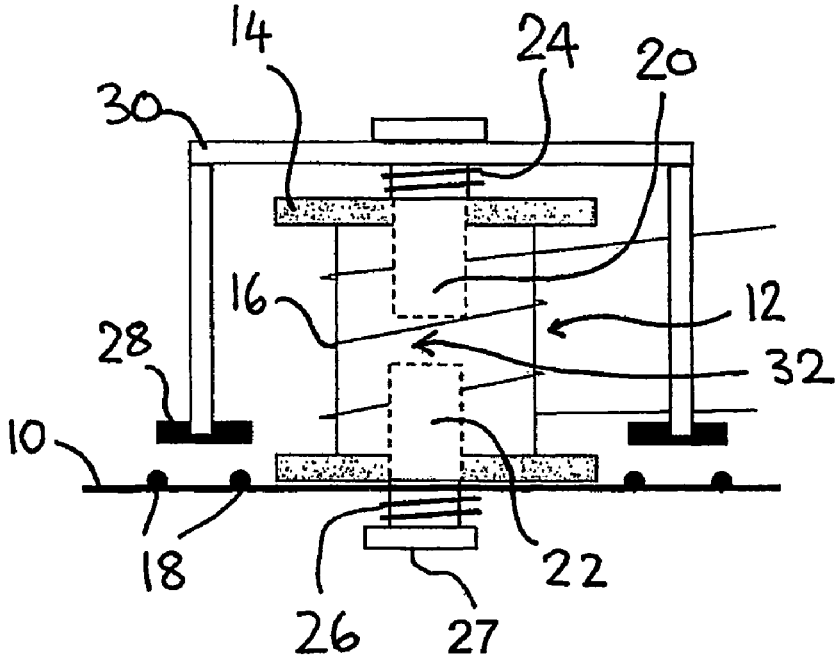
FIG. 1 is a schematic diagram of a first embodiment of the invention with the contacts open.
Figure 2:
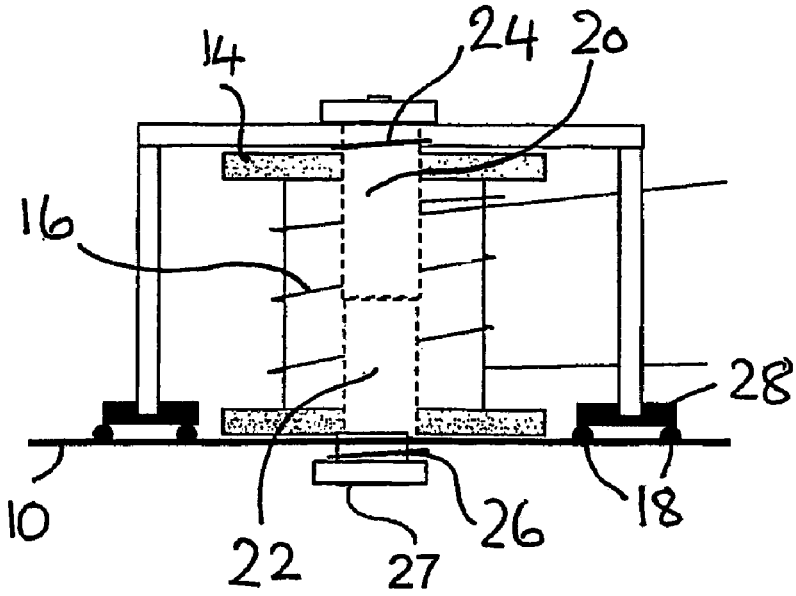
FIG. 2 shows the first embodiment with the contacts closed.

Referring first to FIGS. 1 and 2, the device is mounted on a printed circuit board (PCB) 10 or other item of electrical equipment onto or in which the device is to be incorporated. A fixed solenoid 12, comprising a bobbin 14 and winding 16, is mounted on the PCB 10 and on either side thereof a respective pair of fixed electrical contacts 18 (so-called rivet contacts) are also mounted on the PCB. A first ferromagnetic plunger 20 is slidably mounted in the top end of the solenoid and a second ferromagnetic plunger 22 is slidably mounted in the bottom end of the solenoid (terms of orientation such as "top" and "bottom" refer to the orientation of the device as seen in the drawings and does not limit its orientation in use). Each plunger is resiliently biased by a respective compression spring 24, 26. The springs bias the plungers 20, 22 mutually away from one another so that each tends to be pushed, by its respective spring, in a direction out of the solenoid 12. The first plunger 20 carries movable electrical bridging contacts 28 on a contact carrier 30 mechanically coupled to the plunger. The second plunger 22 has a manual reset button 27.

FIG. 1 shows the situation with no or negligible current flowing in the winding 16. In that case the plungers 20, 22 are held apart by their respective springs 24, 26 with a substantial air gap 32 between them and, in particular, the plunger 20 is held in a first position wherein the bridging contacts 28 are held out of engagement with the fixed contacts 18.

When a current flows through the winding 16 an electromagnetic force is generated which will induce a magnetic attraction between the two plungers 20, 22. In use of the device, the magnitude of this current is chosen to be sufficiently low as to avoid automatic closing of the air gap between the plungers, although above a pre-determined threshold discussed below. Thus, although each plunger may move slightly towards the other against its respective biasing spring, the magnetic attraction between the two plungers is not sufficient to significantly reduce the air gap 32.

However, if the plunger 22 is manually pushed upwardly into the bobbin 14, against the bias of the spring 26, so as to sufficiently reduce the air gap 32 between the two plungers, the magnetic attraction induced between the two plungers will increase to the point where the plunger 22 magnetically entrains the plunger 20. The springs 24, 26 are designed such that the spring 26 tending to push the entrained plungers downwards is sufficiently strong to overcome the spring 24 tending to push them upwards, so that if the plunger 22 is now released it moves downwardly once again towards its initial (FIG. 1) position. This will draw the plunger 20 downwards and further into the body of the solenoid 12 with the result that the mechanically coupled moving contact carrier 30 will also be drawn downwards. The downward travel of the plunger 20 will stop when the moving bridging contacts 28 come to rest (under pressure) on the fixed contacts 18, thereby closing the normally open contacts.

The plunger 20 will be held in this second position as long as the magnitude of the current flowing through the winding 16 is greater than the predetermined threshold referred to above, which is that current magnitude sufficient to induce a magnetic attraction between the entrained plungers greater than the force of the springs 24, 26 tending to separate them. This is referred to as the steady state magnetic force. However, if the magnitude of the current through the winding 16 is reduced below the predetermined threshold the steady state magnetic force will in turn be reduced and the force of the springs 24, 26 will cause the two plungers to separate and thereby allow each plunger to revert to its initial (FIG. 1) position and the bridging contacts 28 disengage the fixed contacts 18.

Figure 3:
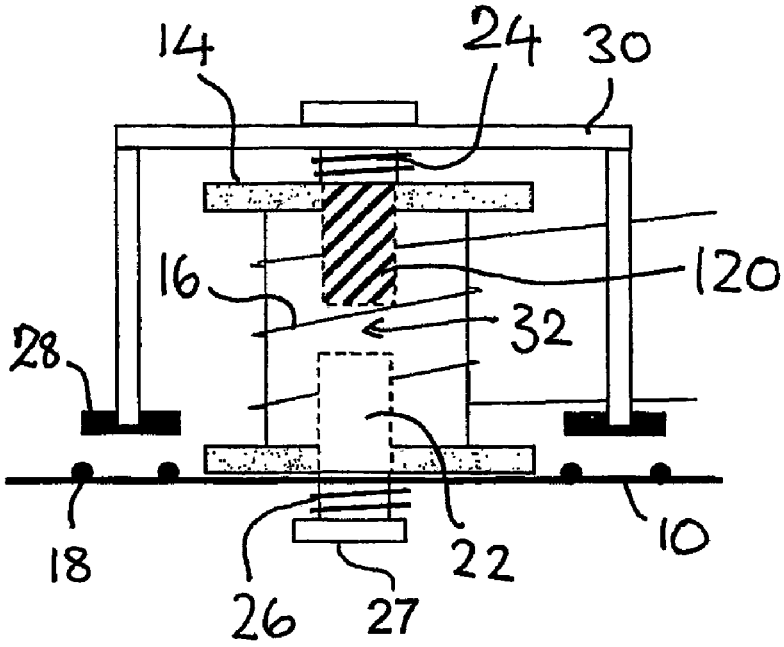
FIG. 3 is a schematic diagram of a second embodiment of the invention with the contacts open.
Figure 4:
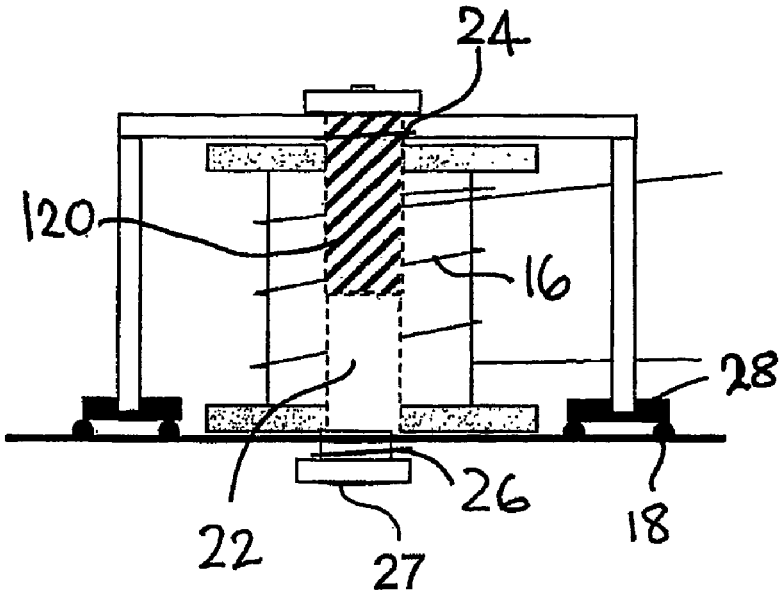
FIG. 4 shows the second embodiment with the contacts closed.

The embodiment of FIGS. 1 and 2 is known as an electrically latching mechanism because the mechanism can only be latched when a current of sufficient magnitude flows through the solenoid winding 16. A second embodiment shown in FIGS. 3 and 4 provides for a mechanically latching mechanism which can be latched in the absence of current flow through the winding. In the embodiment of FIGS. 3 and 4, the plunger 20 is replaced by a plunger 120 having substantially the same dimensions as the plunger 20 but which is a permanent magnet. In all other respects the structure of the embodiment of FIGS. 3 and 4 is the same as that of FIGS. 1 and 2.

In the initial open state, FIG. 3, no or negligible current flows through the winding 16. The magnetic attraction between the plungers 120 and 22, generated by the permanent magnetism of the plunger 120, is insufficient to draw the two plungers together (i.e. to significantly reduce the air gap 32 between the two plungers). However, when the plunger 22 is manually pushed into the bobbin 14 the air gap 32 is sufficiently reduced that plunger 22 magnetically entrains plunger 120. When the plunger 22 is released it moves towards its first (FIG. 3) position, drawing plunger 120 and the movable contact carrier 30 in the same direction. The entrained plungers 22, 120 and the contact carrier 30 will come to rest when the movable contacts 28 engage the fixed contacts 18. The device is now in the closed state (FIG. 4). The magnetic force generated by the permanent magnet (plunger 120) under this condition is referred to as the steady state magnetic force and is sufficiently strong to overcome the combined force of the springs 24, 26 tending to separate them, and ensures reliable operation through adequate contact pressure at rated load current.

Any current flow though the winding 16 will result in the establishment of an electromagnetic field within the solenoid. Dependent on the polarity of the current, this magnetic field will be in the same direction or in the opposite direction to that of the permanent magnet. If the electromagnetic field is in the opposite direction it will reduce the steady state magnetic force holding the plungers 22, 120 together. By increasing the current magnitude through the winding 16 from a negligible level, a state will eventually be reached where the net force of magnetic attraction between the plungers is no longer strong enough to hold them together against the force of the springs 24, 26 tending to separate them, at which point the plungers will spring apart and revert to their initial (FIG. 3) positions. The magnetic force generated by the current through the winding need only to be of sufficient strength to weaken the net magnetic force to a level where separation of the plungers is assured. This means that the current level through the coil can be optimised to achieve the desired opening of the contacts without incurring the problems of power dissipation or component stresses that could arise from the use of larger current levels.

In the embodiments of FIGS. 1 to 4, the two plungers are of uniform section with parts of each plunger extending outside the solenoid body. Due to the air gap between them, the solenoid initially exerts an attracting force on each plunger, attempting to draw each into the body of the solenoid and minimise the air gap. The steady state electromagnetic force is insufficient of its own to close the air gap. However, as the air gap between the two plungers is closed as described, there will initially be a directional force applied to both plungers trying to draw them into the solenoid body. However, once the two plungers become entrained, this directional force will cease due to the uniformity of the two plungers and the fact that parts of the plungers will still extend outside the body of the solenoid even when the contacts are closed. The net downward force will then be entirely due to the difference between the forces of the springs 24 and 26, the electromagnetic force being used solely to keep the two plungers entrained. This arrangement allows the contact pressure to be easily quantified and controlled by virtue of the two springs which are therefore substantially the sole determinant of the pressure between the fixed and movable contacts when the contacts are closed.

However, the electromagnetic force can also be used to contribute towards or to determine contact pressure if desired. This can be achieved by modification of the plunger designs so as to maintain a directional force on them after entrainment. For example, the plunger materials could be different, or plunger 20/120 could be tapered such that the upper part is of a larger cross sectional area than the lower part. Due to the larger cross sectional area of the upper part of the plunger, the solenoid will exert a downward pulling force on plunger 20/120 at all times. Under this arrangement the spring 26 can be designed to have a force equal to or less than that of spring 24 such that the electromagnetic force on the entrained plungers is substantially the sole determinant of the pressure between the fixed and movable contacts when the contacts are closed. Such arrangements to achieve directional force are well known in the solenoid and relay industries. The downward force contributed by the solenoid could be used to manipulate the operation of the device in terms of operating characteristics, component characteristics and costs, etc.

The first and second embodiments described above involve manual operation of the device to achieve the closed state. However, the device can also be configured in a third embodiment (FIGS. 5 and 6) to provide for automatic closing of the contacts. The construction of this third embodiments differs from that of FIGS. 1 and 2 only in that the plunger 22 and associated spring 26 are replaced by a fixed ferromagnetic pole piece 122.

Figure 5:
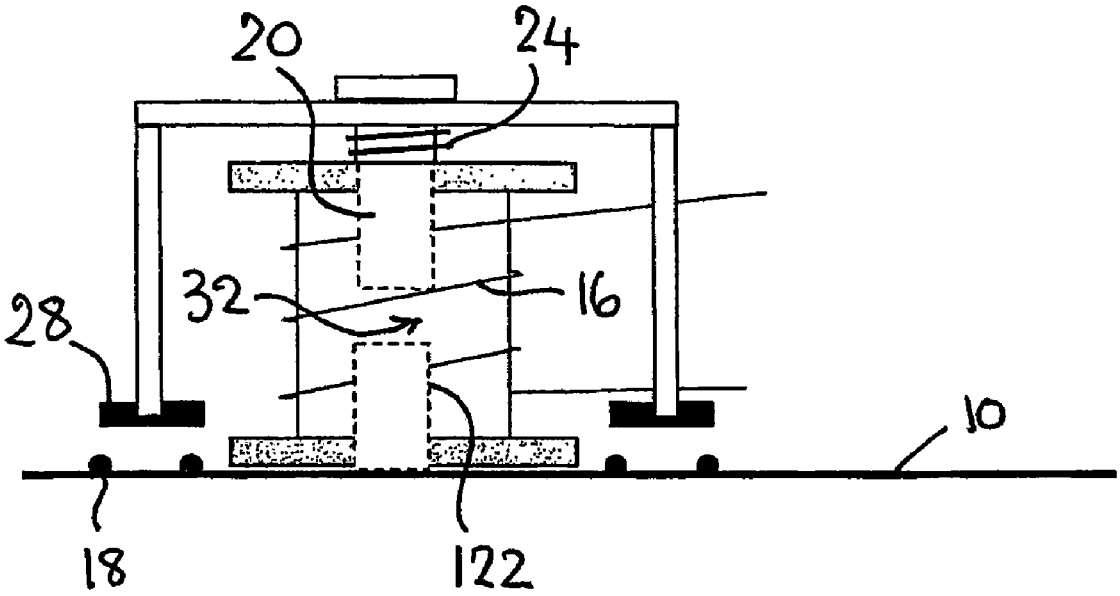
FIG. 5 is a schematic diagram of a third embodiment of the invention with the contacts open.
Figure 6:
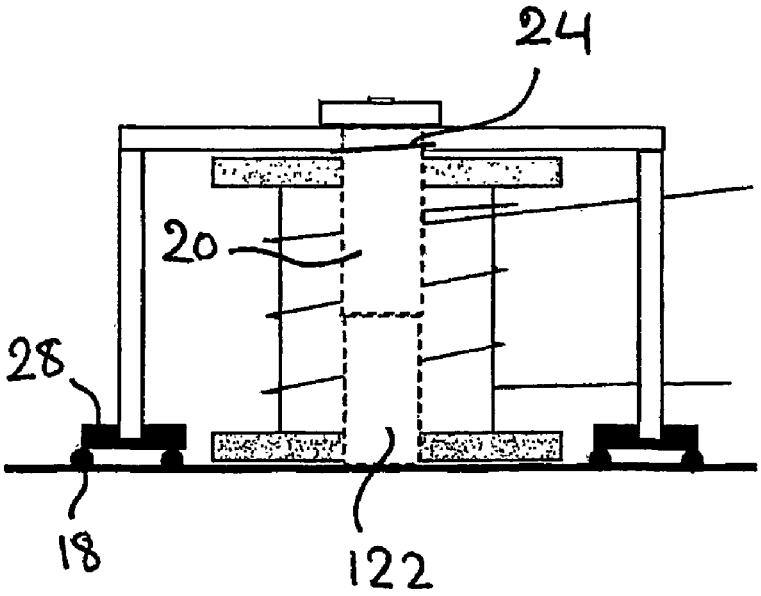
FIG. 6 shows the third embodiment with the contacts closed.

In operation of the device a continuous steady state current flows through the winding 16, but this current is not of a magnitude to induce a magnetic attraction between the pole piece and the plunger 20 of sufficient strength to draw the plunger 20 to the pole piece 122 against the force of the spring 24. The device contacts 18, 28 therefore remain open (FIG. 5). To close the contacts, a pulse of current of substantially higher magnitude is caused to flow through the winding for a short duration. This pulse of current is referred to as the pull-in current. This results in a substantially stronger magnetic field which is sufficient to attract the plunger 20 down into the solenoid body and to substantially close the air gap 32 between the plunger and pole piece, the downward movement of the plunger 20 resulting in closure of the normally open contacts (FIG. 6). With the air gap so reduced or eliminated, the current magnitude can be reduced to the initial steady state value and the force of magnetic attraction between the plunger and the pole piece will remain sufficient to hold the plunger in this second, closed-contacts position. This steady state current is referred to as the holding current. However, if the holding current is reduced below a predetermined threshold, the magnetic attraction between the pole piece and plunger will become insufficient to hold the plunger in the second position against the force of the spring 24, and the plunger will revert to its first position, thereby opening the contacts.

Automatic re-closing of the contacts will occur when the pull-in current is reapplied and the holding current restored. To ensure automatic opening and to prevent unwanted re-closing of the contacts, arrangements can be made with suitable circuitry to ensure that the flow of the holding current and/or the surge current pulse is sufficiently reduced or disabled following the opening action. A reset means can be provided to overcome the disabling means and restore the automatic closing function.

FIGS. 7 to 9A show another embodiment of the invention. This embodiment comprises a solenoid 12 including a bobbin 14 within which is fitted a movable ferromagnetic plunger 22 having a reset button 27, the plunger 22 and reset button 27 being biased into a first position (FIG. 7) by a compression spring 26. The bobbin 14, which has a coil (not shown) wound on it, is fitted to a printed circuit board 10 on which are also fitted two fixed contacts 118. The embodiment further comprises an inverted generally U-shaped moving contact closure member 30 which cooperates with two electrical contacts 128 carried at the ends of respective spring arms 124. The contact closure member 30 is resiliently biased away from the PCB 10 by, in this embodiment, the spring arm 124 so as to maintain the moving contacts 128 normally out of contact with the fixed contacts 118. The moving contact closure member 30 contains a compartment 222 into which is situated a permanent magnet 220.

Figure 8:
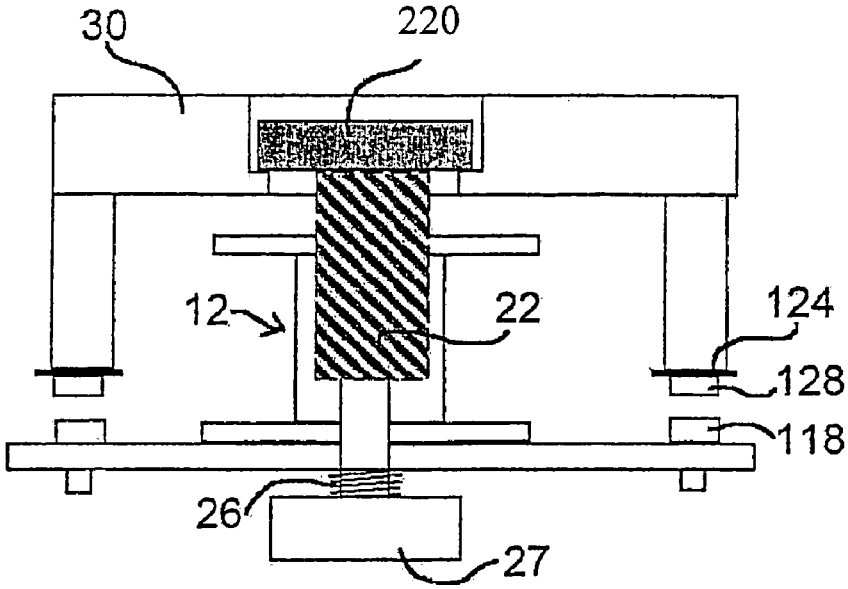
FIG. 8 is a view similar to FIG. 7 of the fourth embodiment with the reset button pushed upwardly to initiate closure of the contacts.

When the reset button 27 is pressed towards the bobbin 14, it reduces the air gap 32 between the top of the plunger 22 and the permanent magnet 220, and when the air gap is sufficiently reduced the permanent magnet is drawn towards the plunger and magnetically couples with it, bringing the moving contact closure member 30 from its first position to an intermediate position as shown in FIG. 8. When the reset button 27 is released, the plunger 22 is returned towards its first position by the force of the reset spring 26 which is greater than the force of the spring 124 tending to hold the moving contact closure member 30 in the open position. Throughout this action, the permanent magnet 220 remains magnetically coupled to the plunger 22, and hence the plunger 22, contact closure member 30 and moving contacts 128 all move in train towards the first position of the plunger 22 when the reset button is released.

When a current flows through the coil of the bobbin, it will generate an electromagnetic field with North and South poles. Dependent on the direction of flow of the current, the electromagnetic pole produced at the top of the plunger 22 will be the same as or opposite to that of the permanent magnet 220, causing the plunger and magnet to further attract each other or to repel each other. By arranging for the current flow to produce opposing magnetic fields at the interface of the plunger and permanent magnet, the net magnetic attraction between the two parts will be reduced. When this magnetic holding force is sufficiently reduced, by an increase in the current above a certain threshold, the opening force of the biasing means 124 acting on the moving contact closure member 30 will cause the moving contacts 128 to separate from the fixed contacts 118 to bring the device to the open position, FIG. 7. Thus automatic opening is provided by the flow of a current of appropriate magnitude and direction through the coil.

A features of the above embodiment is that when the contacts 118/128 are in the closed position, there is still a certain amount of travel available to enable the reset button 27 and plunger 22 to return to the initial position of FIG. 1. Thus, the reset button has two distinct positions, the contacts open position and the contacts closed position. The difference in these two positions may be used to indicate the contact open and closed states.

Figure 7:
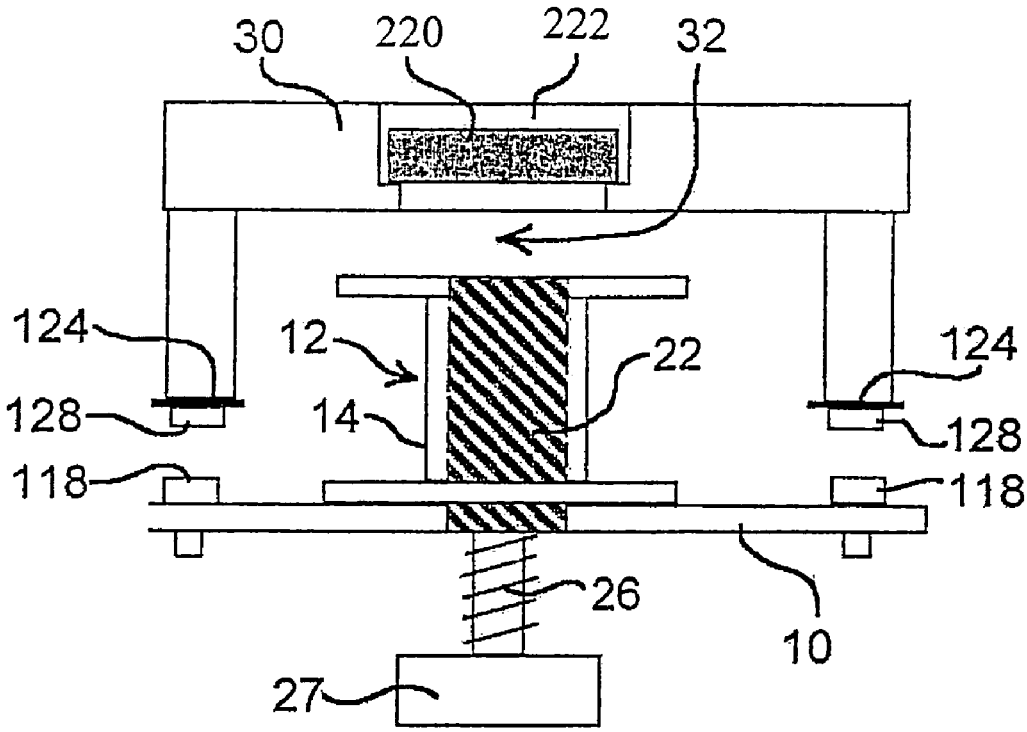
FIG. 7 is a schematic diagram of a fourth embodiment of the invention with the contacts open.
Figure 7A:
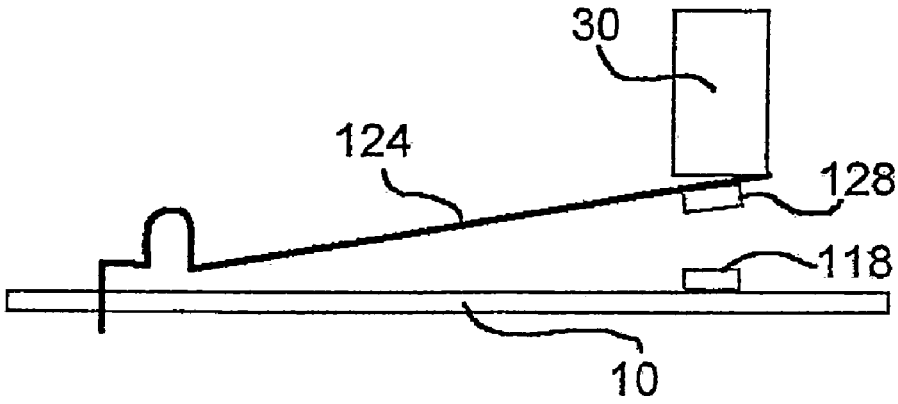
FIG. 7A is a side view of the moving contact carrier of FIG. 7 with the contacts open.
Figure 9:
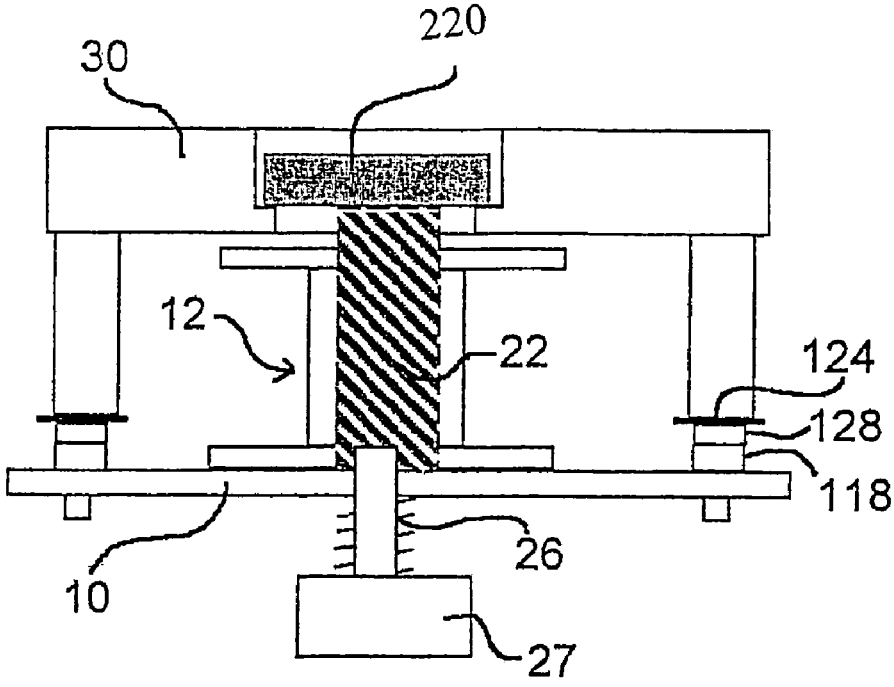
FIG. 9 is a view similar to FIG. 7 showing the fourth embodiment with the contacts closed.
Figure 9A:
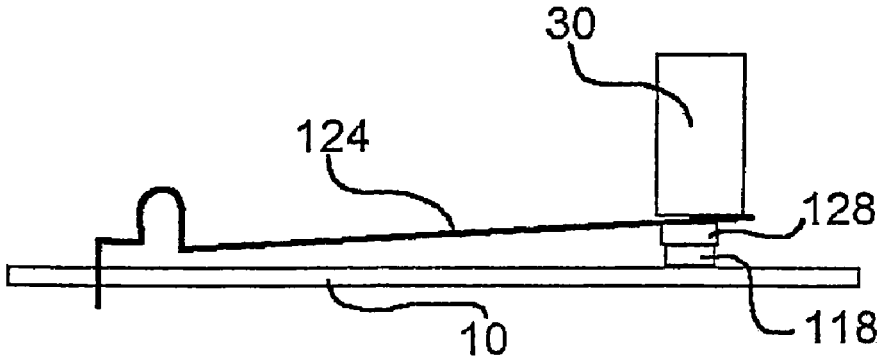
FIG. 9A is a side view of the moving contact carrier of FIG. 7 with the contacts closed.

Furthermore, if an additional downward (as seen in FIG. 9) force of sufficient magnitude is applied to the reset button 27 when the contacts are in the closed position, the reset button and plunger will be drawn to their first position. Such a force may be applied manually by pulling the reset button towards its first position. Given that the moving contact closure member 30 will not be able to move further in the direction of the PCB 10, due to the engagement of the contacts 118/128, an increasing air gap will be opened between the permanent magnet 220 and plunger 22, with a resultant weakening of the magnetic holding force. The design can be arranged to ensure that when the reset button is drawn to its initial position, the bias 124 acting on the moving contact closure member 30 is sufficient to move the latter automatically to its initial contacts-open position (FIG. 7). Thus, this embodiment is provided with manual opening means in addition to the automatic opening means.

Figure 10:
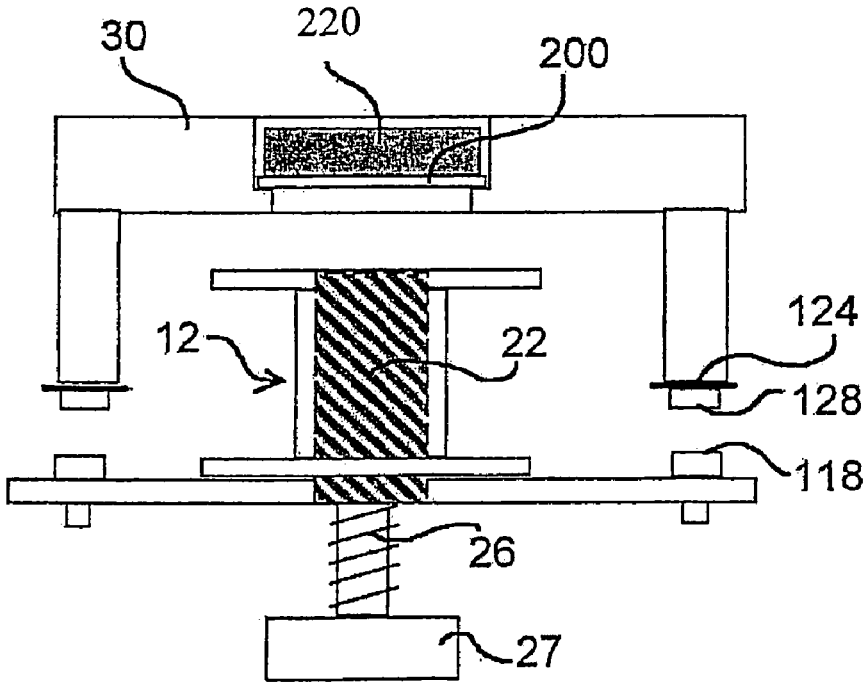
FIG. 10 is a schematic diagram of a fifth embodiment of the invention with the contacts open.

The embodiment of FIG. 7 does not require any electrical energy to enable the circuit breaker to be closed, but does require electrical energy to automatically open the circuit breaker. The embodiment of FIG. 10 is an electrically latching version of the embodiment of FIG. 7. In the embodiment of FIG. 10, a non-ferromagnetic spacer 200 has been placed on the underside of the permanent magnet 220. This spacer has the effect of ensuring that a minimum air gap is maintained between the plunger 22 and the permanent magnet 220 when the plunger is presented to the permanent magnet. Due to the air gap, the magnetic coupling between the plunger and the permanent magnet will be relatively weak and as a result closing of the contacts will not be possible by use of the permanent magnet alone. To facilitate closing of the circuit breaker, a current is passed through the coil which generates an electromagnetic field which produces a polarity at the top of the plunger 22 of like polarity to that of the permanent magnet 220, resulting in an increased magnetic coupling force. When this current is sufficiently increased, the permanent magnet 220 will be magnetically entrained with the plunger 22 and the moving contact closure member 30 can be brought to the second position under the force of the reset spring 26 so as to ensure closing of the fixed and moving contacts 118/128. When the current through the coil is reduced below a certain threshold, the magnetic force of the permanent magnet 220 will not be strong enough to maintain entrainment with the plunger 22, and the moving contacts 128 will move automatically to the open position. Thus, in the embodiment of FIG. 10, the presence of a current of sufficient magnitude and direction facilitates manual closing of the contacts, and reduction of the magnitude of this current results in automatic opening of the contacts.

The basic functionality of both embodiments of FIGS. 7 and 10 can be achieved as shown herein and in other ways without departing from the principles of the invention. For example, in the embodiment of FIG. 10, weakening of the permanent magnet attracting force could be achieved by the use of a weaker magnet, or by reducing the length of the plunger or by reducing the cross sectional area of the plunger, etc. The mechanism could be fitted on to any suitable medium other than a printed circuit board. An opening spring could be fitted between the bobbin and the moving contact closure member to obviate the need for spring biased moving contact arm, etc. A flag indicator may be fitted to the moving contact closure member or the moving contacts to indicate the contact open and closed states, etc.

Enhancements can be made to the embodiments described above, such as provision of a ferromagnetic frame to improve the magnetic performance of the device, or to provide means to indicate the open and closed states of the contacts, etc., without detracting from the basic principle of operation.

The invention is not limited to the embodiments described herein which may be modified or varied without departing from the scope of the invention.

What is claimed is:

1. A resettable switching device comprising a solenoid for mounting with its axis substantially perpendicular to a circuit board, a movable contact closure member having a pair of arms which extend along opposite sides of the solenoid, each arm being arranged to bring a movable contact into engagement with at least one respective contact fixed to the circuit board adjacent to the solenoid, a first ferromagnetic element, a resilient biasing means for biasing the contact closure member towards a first position wherein the movable contacts do not engage the fixed contacts, and a second ferromagnetic element for drawing the first element to and holding it in a second position by magnetic attraction against the action of the resilient bias, the movable contact engaging the fixed contact in the second position of the first element, wherein when a predetermined current condition exists in the solenoid the magnetic attraction between the second element and the first element is reduced below the level necessary to hold the first element in the second position so that the first element is released by the second element and moves towards the first position under the action of the resilient bias and the movable contact disengages the fixed contact, wherein one end of the solenoid is fixedly mountable to the circuit board, the movable contact closure member is disposed at the opposite end of the solenoid to the said one end, and the movable contact closure member includes the first ferromagnetic element.

2. A resettable switching device as claimed in claim 1, wherein the first ferromagnetic element is a permanent magnet, and wherein the second ferromagnetic element is movable in the solenoid, against a further resilient biasing means, towards the permanent magnet to magnetically entrain the latter and upon release of the second element to draw the contact closure member, under the action of the further resilient biasing means, to the second position.

3. A resettable switching device as claimed in claim 2, wherein the permanent magnet is fitted within the movable contact closure member.

4. A resettable switching device as claimed in claim 2, wherein the permanent magnet and second ferromagnetic element are held together against the first and second resilient biasing means tending to separate them by the force of attraction between them, the predetermined current condition being the presence of a solenoid current of sufficient magnitude and direction to induce a magnetic field in opposition to that of the permanent magnet so that the force of attraction between the permanent magnet and second ferromagnetic element becomes less than the force of the resilient biasing means tending to separate them.

5. A resettable switching device as claimed in claim 2, wherein one of the permanent magnet and second ferromagnetic element has a non-ferromagnetic spacer which maintains a minimum separation between them such that the second ferromagnetic element can only entrain the permanent magnet by the additional magnetic attraction produced by a solenoid current above a predetermined threshold, the predetermined current condition being the reduction of the solenoid current below the threshold.

6. A resettable switching device as claimed in claim 1, wherein the second element comprises a plunger slidable in the solenoid, the first and second elements being biased by respective resilient biasing means mutually away from one another, and wherein the plunger is movable in the solenoid against its resilient bias to magnetically entrain the first element.

7. A resettable switching device as claimed in claim 6, wherein the resilient bias acting on the plunger is sufficiently strong to overcome the resilient bias on the first element that upon release of the plunger the latter draws the first element into, and holds the first element at, the said second position in the absence of the said predetermined current condition.

8. A resettable switching device as claimed in claim 7, wherein the difference in the forces exerted by the respective resilient biasing means is substantially the sole determinant of the pressure between the fixed and movable contacts when the first element is in the second position.

9. A resettable switching device as claimed in claim 6, wherein the first and second elements are held together against the respective resilient biasing means tending to separate them by magnetic attraction induced by a solenoid current above a predetermined threshold, the predetermined current condition being the reduction of the solenoid current below the threshold.

10. A resettable switching device as claimed in claim 9, wherein the electromagnetic force on the entrained elements is substantially the sole determinant of the pressure between the fixed and movable contacts when the first element is in the second position.

11. A resettable switching device as claimed in claim 6, wherein the first and second elements are held together against the respective resilient biasing means tending to separate them by permanent magnetism of at least one of the elements, the predetermined current condition being the presence of a solenoid current of sufficient magnitude and direction to induce a magnetic field in opposition to that of the permanent magnet so that the force of attraction between the elements becomes less than the force of the resilient biasing means tending to separate them.

12. A resettable switching device as claimed in claim 6, wherein the first and second elements are respective plungers entering the solenoid from opposite ends.

13. A resettable switching device as claimed in claim 1, wherein the second ferromagnetic element comprises a fixed pole piece, the first element being drawn towards the pole piece against its resilient bias by magnetic attraction induced by a sufficiently high solenoid current and being held in its second position by the pole piece by magnetic attraction induced by a solenoid current above a predetermined threshold which is less than the said sufficiently high current, the predetermined current condition being the reduction of the solenoid current below the threshold.

* * * * *